US010317841B2

(12) United States Patent
Yoshimura et al.

(10) Patent No.: US 10,317,841 B2
(45) Date of Patent: Jun. 11, 2019

(54) IMAGE FORMING APPARATUS

(71) Applicant: CANON KABUSHIKI KAISHA, Tokyo (JP)

(72) Inventors: Akira Yoshimura, Suntou-gun (JP); Tomoya Kuruma, Yokohama (JP); Akimichi Suzuki, Yokohama (JP); Satoshi Nishida, Numazu (JP); Kazuhiro Doda, Yokohama (JP); Isamu Takeda, Machida (JP); Takanori Mitani, Meridian, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/173,400

(22) Filed: Jun. 3, 2016

(65) Prior Publication Data

US 2016/0357145 A1 Dec. 8, 2016

(30) Foreign Application Priority Data

Jun. 8, 2015 (JP) ..... 2015-116138
Jun. 10, 2015 (JP) ..... 2015-117601

(51) Int. Cl.
*G03G 15/00* (2006.01)
*G03G 21/20* (2006.01)
*G03G 15/20* (2006.01)

(52) U.S. Cl.
CPC ..... *G03G 21/206* (2013.01); *G03G 15/6552* (2013.01); *G03G 15/6573* (2013.01); *G03G 15/2053* (2013.01); *G03G 2215/2035* (2013.01)

(58) Field of Classification Search
CPC ..... B41J 29/377; G03G 15/20; G03G 21/20
See application file for complete search history.

(56) References Cited

U.S. PATENT DOCUMENTS 5,647,678 A * 7/1997 Trombley ..... B41J 29/377 347/223
6,445,892 B1 * 9/2002 Kelsay ..... G03G 21/20 399/92
6,522,841 B2 * 2/2003 Horikoshi ..... B65H 29/14 271/211
6,788,905 B2 * 9/2004 Tsutada ..... G03G 15/6573 399/396
9,229,429 B2 * 1/2016 Akatsuka ..... G03G 21/206
(Continued)

FOREIGN PATENT DOCUMENTS

CN 101788775 A 7/2010
JP S62-140058 U 9/1987
(Continued)

*Primary Examiner* — Matthew G Marini
*Assistant Examiner* — Marissa Ferguson-Samreth
(74) *Attorney, Agent, or Firm* — Canon U.S.A., Inc. I.P. Division

(57) ABSTRACT

An image forming apparatus includes pair of ejection rollers that are used for ejecting a recording material to a stacking unit from a main body of the image forming apparatus and a cooling unit. The cooling unit includes, air-blowing ports that are used for blowing air onto the recording material in a direction crossing a transport direction of the recording material are positioned in a region that is located above the position of a nip portion of the pair of ejection rollers and below an extension line tangent to the nip portion of the pair of ejection rollers.

13 Claims, 9 Drawing Sheets

(56) References Cited

U.S. PATENT DOCUMENTS

| | | | | |
|---|---|---|---|---|
| 2005/0074255 | A1* | 4/2005 | Awaya | G03G 21/206 399/92 |
| 2007/0139731 | A1* | 6/2007 | Saito | H04N 1/00 358/498 |
| 2007/0196152 | A1* | 8/2007 | Shimizu | G03G 15/6573 399/405 |

FOREIGN PATENT DOCUMENTS

| | | | | | |
|---|---|---|---|---|---|
| JP | 10-240104 | | * | 9/1998 | G03G 21/20 |
| JP | H11-139680 | A | | 5/1999 | |
| JP | 11-219097 | | * | 8/1999 | G03G 21/20 |
| JP | 2001122490 | A | * | 5/2001 | B65H 29/24 |
| JP | 2002-128363 | | * | 5/2002 | B65H 31/00 |
| JP | 2002-229419 | | * | 8/2002 | G03F 21/20 |
| JP | 2003-066793 | | * | 3/2003 | G03G 21/00 |
| JP | 2003066793 | A | * | 3/2003 | G03G 21/20 |
| JP | 2003-223093 | | * | 8/2003 | G03G 21/20 |
| JP | 2005-77565 | A | | 3/2005 | |
| JP | 2005-338675 | | * | 12/2005 | H03H 21/00 |
| JP | 2006017817 | A | * | 1/2006 | G03G 21/20 |
| JP | 2006-290574 | A | | 10/2006 | |
| JP | 2007-219399 | A | | 8/2007 | |
| JP | 2007-331869 | A | | 12/2007 | |
| JP | 2008299099 | A | * | 12/2008 | G03G 21/20 |
| JP | 2010-078674 | A | | 4/2010 | |
| JP | 2014-126763 | A | | 7/2014 | |

* cited by examiner

IMAGE FORMING APPARATUS

BACKGROUND OF THE INVENTION

Field of the Invention

The present invention relates to image forming apparatuses, such as copying machines, printers, facsimile machines, and multifunction apparatuses, that employ an electrophotographic system and perform image formation.

Description of the Related Art

In the related art, a toner image formed on a recording material by using an electrophotographic process undergoes a heating and fixing treatment performed by a fixing unit. Recording materials to which toner images have been fixed are ejected to a stacking tray by a transport device. The recent increase in printing speed is one of the reasons that recording materials to which toner images have been fixed are stacked in a stacking tray while the temperatures of the recording materials are still high. In addition, when a printing operation is continuously performed, sheet members are consecutively stacked in a stacking tray before they are cooled, and as a result, toners on the sheet members may re-melt. The toners that have re-melted stick to the sheet members and toner images that are superposed with the toners. By separating the sheets, which have been stuck to each other, from each other, the toner images of plural sheets become separated from the sheets simultaneously, and a problem of missing portions of an image occurs. In addition, with the recent demands from users for power-saving products, the melting points of toners are likely to decrease, and accordingly, toners fixed to sheet members in a stacking tray are more likely to re-melt.

For example, Japanese Patent Laid-Open No. 2005-77565 describes that, in an image forming apparatus, an area in the vicinity of ejection rollers that are disposed downstream from a fixing device is cooled by a cooling fan, and that the flow of air from the cooling fan is changed in accordance with the presence or absence of a sheet-ejection device mounted on the image forming apparatus.

However, in the configuration disclosed in Japanese Patent Laid-Open No. 2005-77565, when cooling a recording material, the ejection rollers and the like are also cooled, and thus, a toner image is cooled unevenly due to differences between the temperature of a recording material that is ejected immediately after undergoing a heating and fixing treatment and the temperatures of the ejection rollers and discharge rollers. As a result, an image defect such as a contact mark formed by the ejection rollers sometimes occurs.

SUMMARY OF THE INVENTION

The present invention has been made to address the above situations and is directed at an image forming apparatus that efficiently cools recording materials, which are ejected after toner images have been fixed to the recording materials, so as to suppress the recording materials from sticking to one another due to a melted toner. An image forming apparatus according to an aspect of the present invention includes a pair of ejection rollers that are used for ejecting the recording material to the stacking unit from a main body of the image forming apparatus and a cooling unit that cools the recording material ejected to the stacking unit by the pair of ejection rollers by blowing air onto the recording material. The cooling unit includes, at least one air-blowing port that is used for causing the air to be blown onto the recording material in a direction crossing a transport direction of the recording material is positioned in a region that is located above a position of a nip portion of the pair of ejection rollers and below an extension line tangent to the nip portion of the pair of ejection rollers.

Further features of the present invention will become apparent from the following description of exemplary embodiments with reference to the attached drawings.

DESCRIPTION OF THE EMBODIMENTS

Embodiments of the present invention will be described in detail below as examples with reference to the drawings. However, dimensions, materials, shapes, and the relative positions of the components in the following embodiments should be suitably changed in accordance with the configuration of an apparatus to which the present invention may be applied and in accordance with various conditions. Therefore, the scope of the present invention is not limited to the dimensions, materials, shapes, and the relative positions of the components in the following embodiments unless otherwise particularly stated.

First Embodiment

Figure 1:
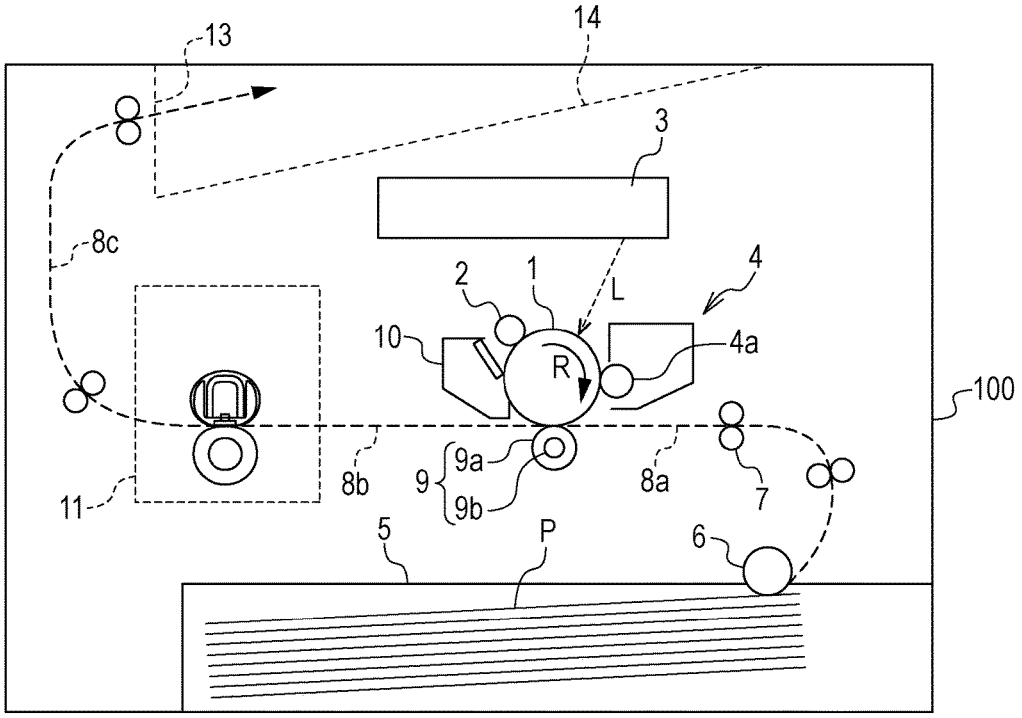
FIG. 1 is a schematic diagram illustrating an example of the configuration of an image forming apparatus according to the present invention.

FIG. 1 is a schematic diagram illustrating an example of the configuration of an image forming apparatus according to the first embodiment. An image forming apparatus 100 according to the first embodiment is a full-color laser beam printer that employs an electrophotography system. The image forming apparatus 100 employs an electrophotography system and can form an image on a recording material, such as a recording sheet or an OHP sheet, in accordance with a signal transmitted from an external device, such as a personal computer, that is connected to the image forming apparatus 100 so as to be capable of communicating with the image forming apparatus 100.

As illustrated in FIG. 1, the image forming apparatus 100 according to the first embodiment includes a photoconductor drum 1 that serves as an image bearing member. The photoconductor drum 1 is driven so as to rotate in the direction of arrow R at a predetermined peripheral speed (process speed). The photoconductor drum 1 is uniformly charged (in a first charging process) by a charging unit such as a charging roller 2 so as to have a predetermined polarity and a predetermined electric potential. The photoconductor drum 1 that has been charged is exposed to light by a laser-beam scanner 3, which is an exposure unit. The exposure unit 3 outputs a laser beam L that is on/off-modulated in accordance with a time-series electric digital pixel signal of a target image information item input from an external device (not illustrated) such as an image scanner or a computer, and the exposure unit 3 scans and irradiates (radiates the laser beam L onto) a charged surface of the photoconductor drum 1. As a result of performing this scanning and irradiating operation, an electric charge in a light-exposed portion of the surface of the photoconductor drum 1 is removed, and an electrostatic latent image corresponding to the target image information item is formed on the surface of the photoconductor drum 1.

An electrostatic latent image formed on the photoconductor drum 1 is developed by a developing unit 4. A developer (toner) is supplied to the surface of the photoconductor drum 1 from a developing sleeve 4*a* included in the developing unit 4, and the electrostatic latent image on the surface of the photoconductor drum 1 is sequentially developed into a toner image. In the case of a laser beam printer, a reversal developing system in which an electrostatic latent image is developed by causing a toner to be deposited onto a light-exposed portion of the electrostatic latent image is generally employed.

Recording materials P that are stacked in a sheet-feeding cassette 5, which is a sheet-feeding device, are separated from one another and fed one by one by a sheet-feeding roller 6 on the basis of a sheet-feeding start signal. After that, one of the recording materials P passes through registration rollers 7 and a sheet path 8*a* and is transported, at a predetermined timing, to a contact nip portion R (transfer section) formed by the photoconductor drum 1 and a transfer roller 9, which serves as a transfer member. In other words, transportation of the recording material P is controlled by the registration rollers 7 in such a manner that a front edge of the recording material P reaches the transfer portion R at the same time as a front edge of a toner image on the photoconductor drum 1 reaches the transfer portion R.

During the period when the recording material P, which has been transported to the transfer portion R, is nipped and transported through the transfer portion R, a predetermined, controlled transfer voltage (transfer bias) is applied to the transfer roller 9 by a transfer power supply (not illustrated). By applying a transfer bias having a polarity opposite to that of the toner to the transfer roller 9, the toner image on the surface of the photoconductor drum 1 is electrostatically transferred onto a surface of the recording material P in the transfer portion R.

The recording material P, to which the toner image has been transferred in the transfer portion R, is separated from the surface of the photoconductor drum 1, and the recording material P is transported and introduced into a heating device 11 by passing through a sheet path 8*b*. Then, the recording material P undergoes heating, pressing, and fixing treatments for the toner image. After the recording material P has been separated from the surface of the photoconductor drum 1 (after the toner image has been transferred to the recording material P), a cleaning device 10 cleans the surface of the photoconductor drum 1 by removing residual toner, paper dust, and the like, and the photoconductor drum 1 is repeatedly used in image formation. The recording material P that has passed through the heating device 11 is guided toward a sheet path 8*c* and ejected to a sheet-ejection tray 14, which is a stacking unit, via an ejection opening 13.

(Description of Heating and Fixing Device 11)

Figure 2:
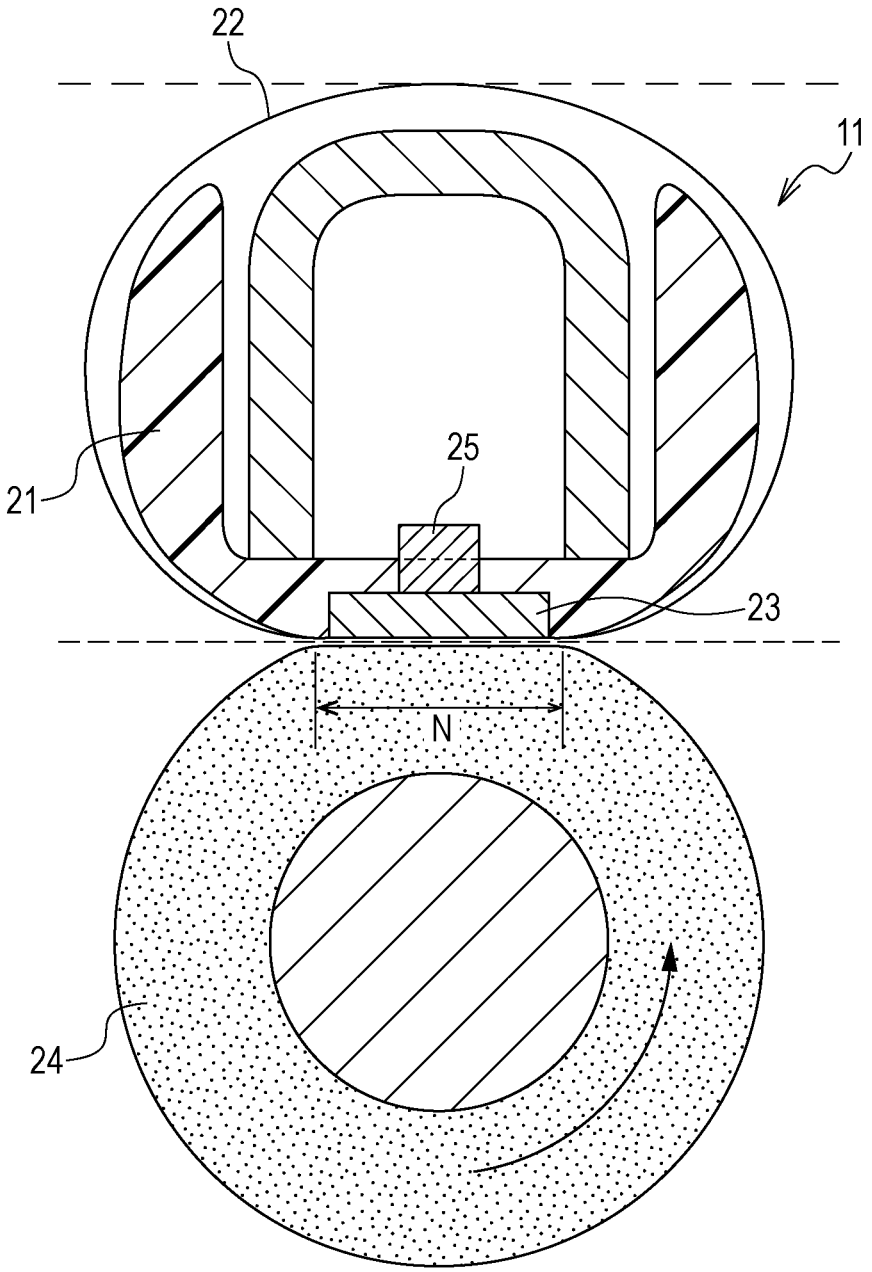
FIG. 2 is a schematic diagram illustrating a heating and fixing device according to a first embodiment of the present invention.

The heating and fixing device 11, which is a fixing unit, according to the first embodiment will now be described. FIG. 2 is a schematic diagram illustrating the heating and fixing device 11 according to the first embodiment. A film guide 21 is a member that guides a film 22 and that has heat resistance and rigidity, and the film guide 21 is reinforced by a reinforcing member. The heating member 23 is a ceramic heater and heats the film 22. The film 22 is an endless heat-resistant film and is fitted to the exterior of a film-guiding member 21 including the heating member 23. The inner peripheral length of the endless heat-resistant film 22 is set to be longer than the outer peripheral length of the film guide 21 including the heating member 23 by, for example, about 3 mm, and thus, the film 22 is fitted to the exterior of the film guide 21 with some leeway.

The film guide 21 can be made of a highly heat-resistant resin, such as a polyimide, polyamidoimide, polyether ether ketone (PEEK), polyphenylene sulfide (PPS), or a liquid crystal polymer, and alternatively, the film guide 21 can be made of a composite material containing, for example, one of the above-mentioned resins and a ceramic, a metal, or glass or the like. In the first embodiment, a liquid crystal polymer is used. A U-shaped sheet metal can be made of a metal, such as stainless steel (SUS) or iron. In order to cause the film 22 to have a small heat capacity and to improve the quick start-up performance of the film 22, a heat-resistant film having a film thickness of 100 μm or less and preferably of 50 μm or less and 20 μm or more can be used as the film 22. In the first embodiment, a polyimide film having a film thickness of about 50 μm whose outer peripheral surface is coated with polytetrafluoroethylene (PTFE) is used. The outer diameter of the film 22 is set to 18 mm.

A pressure roller 24 forms a nip portion N with the film 22 interposed between the pressure roller 24 and the heating member 23, and the pressure roller 24 is a film-outer-surface-contact driving unit that drives the film 22 so that the film 22 rotates. The pressure roller 24 includes a core metal, an elastic body layer, and a release layer, which is an outermost layer, and is arranged so as to be pressed into contact with a surface of the heating member 23 with the film 22 interposed between the pressure roller 24 and the heating member 23 as a result of receiving a predetermined pressing force by a bearing unit and an urging unit (not illustrated).

The pressure roller 24 is driven by a driving system (not illustrated) so as to rotate in the direction of an arrow in FIG. 2 at a predetermined peripheral speed. As a result of the pressure roller 24 being driven so as to rotate, a force that causes the film 22 to rotate is applied to the film 22 by friction generated between the pressure roller 24 and the outer surface of the film 22 in the nip portion N. The film 22 is driven so as to rotate around the exterior of the stay 21 in the direction of the arrow at substantially the same peripheral speed as that at which the pressure roller 24 rotates while the inner surface of the film 22 is in close contact with and is sliding along the surface of the heating member 23 in the nip portion N.

Figure 3:
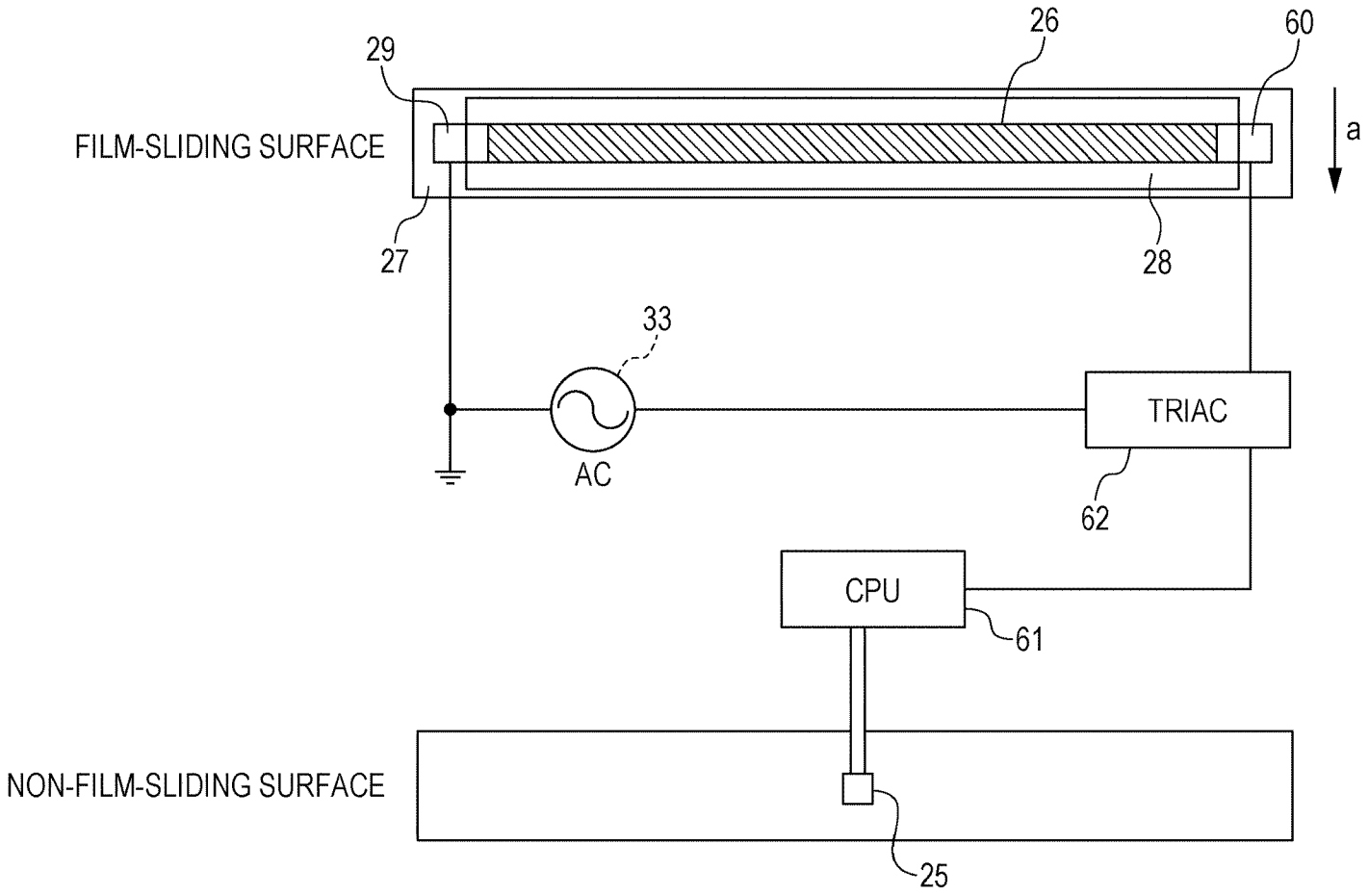
FIG. 3 is a schematic diagram illustrating a circuit that controls energization of a heating member.

FIG. 3 is a diagram illustrating a circuit that controls energization of the heating member 23. The heating member 23 includes an elongated substrate 27 whose longitudinal direction is perpendicular to a transport direction a of the recording materials P, which are members to be heated. In addition, the heating member 23 includes a resistance heating element 26, which is formed so as to extend in the longitudinal direction of the substrate 27 and to be included in a surface (film-sliding surface) of the substrate 27, and a heat-resistant overcoat layer 28, which protects the surface of the heating member 23 on which the resistance heating element 26 is formed. Furthermore, the heating member 23 includes power-supplying electrodes 29 and 60 at the longitudinal ends of the resistance heating element 26, and the overall heat capacity of the heating member 23 is low.

The substrate 27 of the heating member 23 has heat resistance and an insulating property and is made of, for example, a ceramic material such as alumina or aluminum nitride. Each of the power-supplying electrodes 29 and 60 is formed of a silver palladium pattern formed by screen printing. A main reason why the overcoat layer 28 of the resistance heating element 26 is provided is to ensure electrical insulation between the resistance heating element 26 and the surface of the heating member 23 and the slidability of the film 22. In the first embodiment, a heat-resistant glass layer having a thickness of about 50 μm is used as the overcoat layer 28.

FIG. 3 also illustrates the rear surface (non-film-sliding surface) of the heating member 23. A thermistor 25 is a thermometric element that is disposed in order to detect the temperature of the heating member 23, and the thermistor 25 is isolated from the heating member 23. The thermistor 25 is formed by, for example, fixing a chip thermistor element onto a support on which a heat-insulating layer has been formed and by causing the element to be in contact with the rear surface of the heating member 23 by applying a predetermined pressing force acting downward (toward the rear surface of the heating member 23) to the element. The thermistor 25 is disposed in a minimum sheet-passing region and connected to a central processing unit (CPU) 61, which is a control unit.

The heating member 23 is arranged so as to be fixed in place by exposing the front surface of the heating member 23, which includes the overcoat layer 28 formed thereon, toward a lower side and by causing the front surface of the heating member 23 to be held on a bottom surface of the film guide 21. By employing the above configuration, the overall heat capacity of the heating member 23 can be lower than the case of employing a heat roller system, and quick start-up can be performed. The temperature of the heating member 23 is increased by causing the resistance heating element 26 to generate heat across the entire longitudinal length thereof by supplying power to the power-supplying electrodes 29 and 60 at the longitudinal ends of the resistance heating element 26. The temperature of the heating member 23 is detected by the thermistor 25, and the output of the thermistor 25 is loaded into the CPU 61 by being A/D converted. A triac 62 controls, on the basis of the information regarding the loaded output, the electrical power that is supplied to the resistance heating element 26 by phase control, frequency control, or the like, so that the temperature of the heating member 23 is controlled. In other words, the temperature of the heating member 23 is maintained at a certain degree when a fixing treatment is performed by controlling the energization of the resistance heating element 26 in such a manner that when the temperature detected by the thermistor 25 is lower than a predetermined temperature, the temperature of the heating member 23 is increased, and that when the temperature detected by the thermistor 25 is higher than the predetermined temperature, the temperature of the heating member 23 is decreased.

In a state where the temperature of the heating member 23 has been increased to a predetermined degree, and where the peripheral speed at which the film 22 is caused to rotate by rotation of the pressure roller 24 has become steady, one of the recording materials P is transported to the nip portion N formed by the heating member 23 and the pressure roller 24 with the film 22 interposed between the heating member 23 and the pressure roller 24. Then, the recording material P is nipped and transported through the press-contact nip portion N together with the film 22, and as a result, the heat generated by the heating member 23 is applied to the recording material P via the film 22, so that a toner image on the recording material P is heated and fixed onto a surface of the recording material P. The recording material P that has passed through the nip portion N is separated from the surface of the film 22 and transported.

(Description of Ejected-Sheet-Cooling Unit)

The ejected-sheet-cooling unit will now be described. As described above, when the recording materials P to which toner images have been fixed are ejected to the sheet-ejection tray 14 while the temperatures of the recording materials P are still high, in some cases, toners on the recording materials P re-melt, which in turn results in the recording materials P sticking to one another. When the recording materials P, which have been stuck to each other, are separated from each other, portions of toner images are separated from the recording materials P, and a problem of missing portions of an image occurs. Therefore, the recording materials P stacked in the sheet-ejection tray 14 need to be efficiently cooled. In the first embodiment, an axial flow fan 31 is provided as a cooling unit. The recording materials P are cooled by air supplied by the axial flow fan 31.

Figure 4A:
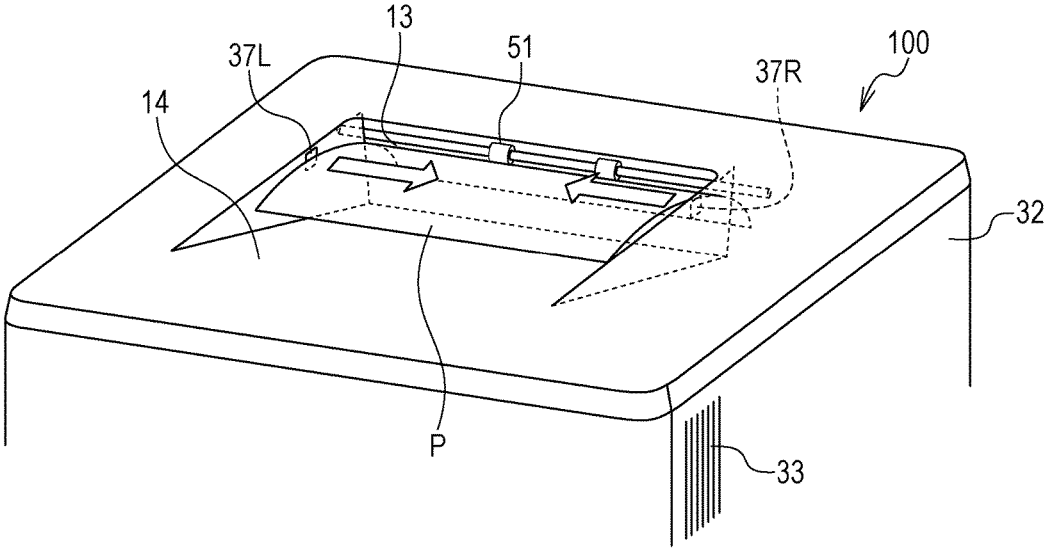
FIG. 4A is a perspective view of an ejected-sheet-cooling unit.
Figure 4B:
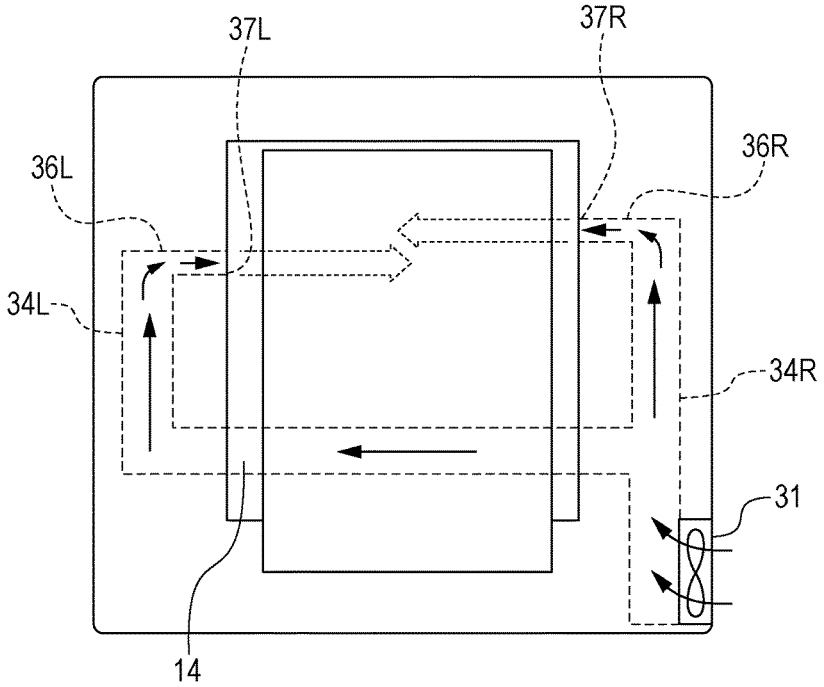
FIG. 4B is a diagram schematically illustrating the configuration of the ejected-sheet-cooling unit when viewed from a top surface of the image forming apparatus.

FIG. 4A is a perspective view of the ejected-sheet-cooling unit, and FIG. 4B is a diagram schematically illustrating the configuration of the ejected-sheet-cooling unit when viewed from the top surface of the image forming apparatus 100. The axial flow fan 31 takes in air from outside the image forming apparatus 100 via a louver 33 formed in an exterior cover 32. The air that has been taken in passes through an air duct 34, which is provided in the image forming apparatus 100, and is sent to guides 36R and 36L (guiding members) each having a desired angle so as to set a direction in which the air is discharged. The air duct 34 has a box shape, so that the air duct 34 can suppress air leakage and effectively send the air. The air duct 34 is separated into a right-side duct path 34R and a left-side duct path 34L in a main body of the image forming apparatus 100. The right-side duct path 34R extends toward an exhaust port 37R, and the left-side duct path 34L extends toward an exhaust port 37L. Accordingly, the axial flow fan 31 is a common cooling fan that supplies air to the duct paths 34R and 34L.

The guide 36R, which is a first guiding member, and the guide 36L, which is a second guiding member, cause the cooling air, which has been discharged, to be jetted out from the exhaust port 37R (first air-blowing unit) and the exhaust port 37L (second air-blowing unit), each of which is an air-blowing port formed in the vicinity of the sheet-ejection tray 14. The exhaust ports 37R and 37L are disposed on opposite sides of the sheet-ejection tray 14 in a width direction of the sheet-ejection tray 14, the width direction being perpendicular to the direction in which the recording materials P are to be ejected, and the direction in which the cooling air is discharged crosses a direction of movement of the recording materials P. In the first embodiment, the direction in which the cooling air is discharged is a direction that is perpendicular to the direction of movement of the recording materials P and is indicated by arrows as illustrated in FIG. 4A. The exhaust ports 37R and 37L are arranged in such a manner as to be displaced from each other by about 20 mm in the direction of movement of the recording materials P in order to prevent air turbulence from occurring as a result of the cooling air sent from an end portion of the exhaust port 37R and the cooling air sent from an end portion of the exhaust port 37L coming into contact with each other.

(Description of Positions of Exhaust Ports 37R and 37L)

Figure 5A:
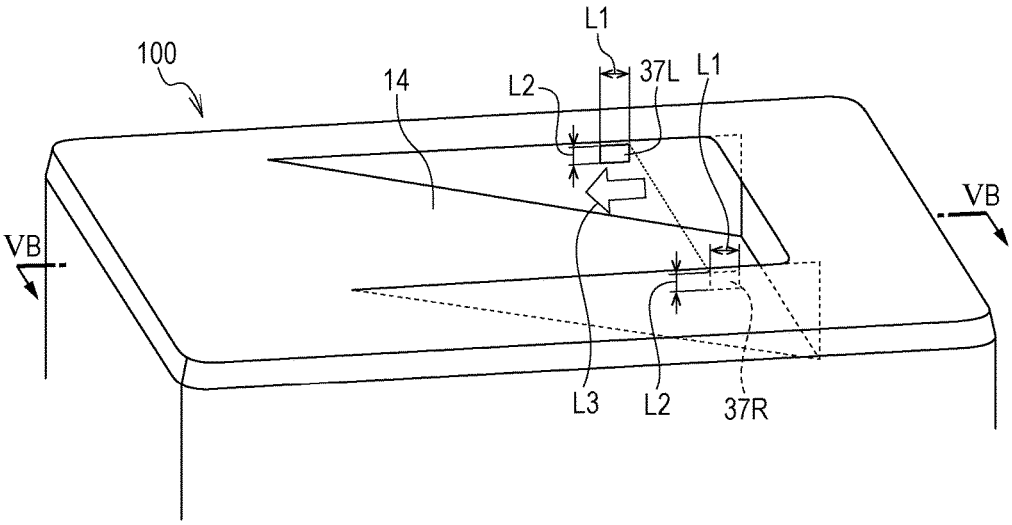
FIG. 5A is a schematic perspective view illustrating the positional relationship between exhaust ports.
Figure 5B:
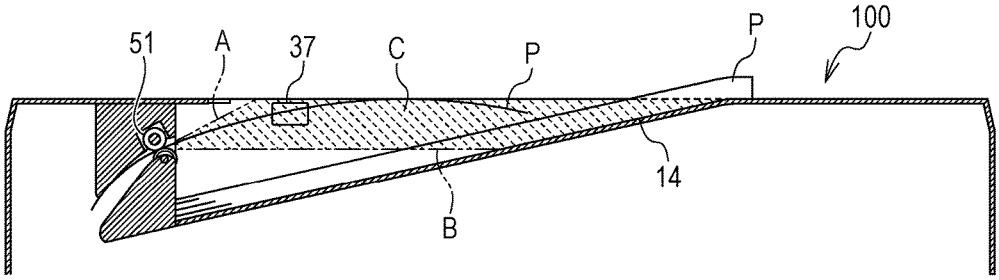
FIG. 5B is a schematic cross-sectional view taken along line VB-VB of FIG. 5A, FIG. 5B illustrating the positional relationship between the exhaust ports.

FIG. 5A is a schematic perspective view illustrating the positional relationship between the exhaust ports 37R and 37L, and FIG. 5B is a schematic cross-sectional view taken along line VB-VB of FIG. 5A illustrating the positional relationship between the exhaust ports 37R and 37L. One of the recording materials P is nipped and transported by a pair of ejection rollers 51 and is transported to the sheet-ejection tray 14 via the ejection opening 13. The recording material P that is nipped by the pair of ejection rollers 51 and that is in the process of being ejected passes through a portion C shaded by dashed lines (see a region above a two-dot chain line B in FIG. 5B) that is surrounded by a nip tangent line A (an extension line tangent to a nip portion) of the pair of ejection rollers 51 and the two-dot chain line B that represents the height of the nip portion between the pair of ejection rollers 51. Here, the direction in which the recording material P is ejected by the pair of ejection rollers 51 is parallel to the direction in which the nip tangent line A extends and is an upward direction with respect to the horizontal direction in the case where the main body of the image forming apparatus 100 is horizontally placed. In the direction in which the recording materials P are to be ejected, the exhaust ports 37R and 37L are positioned downstream from the pair of ejection rollers 51 and upstream from the leading edges of the recording materials P stacked in the sheet-ejection tray 14.

The exhaust ports 37R and 37L are disposed in the area of the dashed-line shaded portion C, through which one of the recording materials P in the process of being ejected passes, so that the exhaust ports 37R and 37L can directly cool the recording material P in the process of being ejected. Each of the exhaust ports 37R and 37L has a discharge opening having a width (L1) of 20 mm and a height (L2) of 3 mm, and the air is to be jetted out through these discharge openings. Regarding the positions of the exhaust ports 37R and 37L, the distance from the ejection opening 13 to the exhaust port 37R is set to 20 mm, and the distance from the ejection opening 13 to the exhaust port 37L is set to 40 mm, so that the air discharged through the exhaust port 37R and the air discharged through the exhaust port 37L are prevented from coming into contact with each other. In the present configuration, since the width (L1) of each of the exhaust ports 37R and 37L is 20 mm, the displacement amount (L3) of the exhaust ports 37R and 37L with respect to each other is set to 20 mm. Therefore, in the case of increasing the width L1 of each of the exhaust ports 37R and 37L, it is desirable that the displacement amount (L3) of the exhaust ports 37R and 37L with respect to each other be increased.

By employing the above-described configuration, the cooling air can flow along a surface of one of the recording materials P rather than a cut surface of the recording material P, and the recording material P can be effectively cooled without the occurrence of air turbulence. As a result, the probability of the recording materials P on the sheet-ejection tray 14 sticking to one another in the case where image formation is performed in a continuous manner can be reduced.

Figure 6:
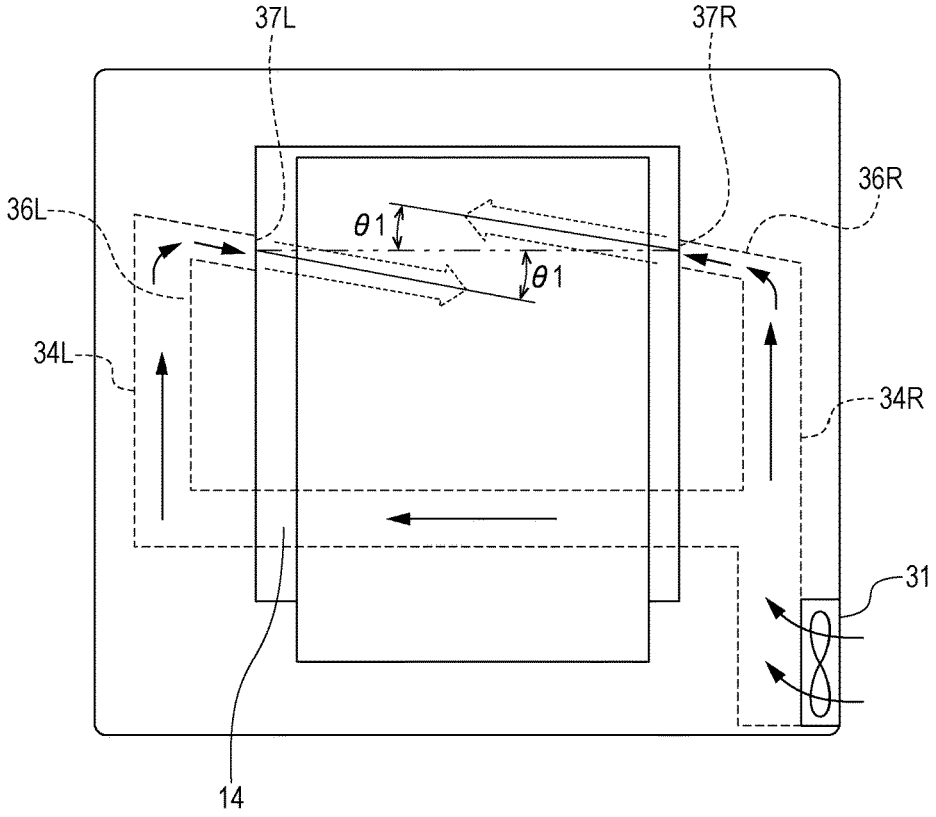
FIG. 6 is a diagram schematically illustrating the configuration of the ejected-sheet-cooling unit when viewed from the top surface of the image forming apparatus, FIG. 6 illustrating other guides according to the first embodiment.

The guides 36R and 36L may be formed so as to cause the cooling air to be discharged at a desired angle. FIG. 6 is a diagram schematically illustrating the configuration of the ejected-sheet-cooling unit when viewed from the top surface of the image forming apparatus 100, FIG. 6 illustrating other guides 36R and 36L according to the first embodiment. Each of the guides 36R and 36L has a predetermined angle θ1 that is set to 5 degrees. In other words, the center line of the first air-blowing unit in an air blowing direction and the center line of the second air-blowing unit in the air blowing direction do not cross each other. Since the longitudinal width (L5) of each of the guides 36R and 36L is 230 mm, as a result of the air being guided at 5 degrees, the air flow discharged through the guide 36R and the air flow discharged through the guide 36L are displaced from each other by about 20 mm at the exhaust ports 37R and 37L, and accordingly, an advantageous effect substantially equivalent to that obtained by the displacement of the exhaust ports 37R and 37L from each other in the first embodiment can be obtained. When the longitudinal widths L5 or the sizes of the exhaust ports 37R and 37L are changed, the predetermined angle θ1 can be changed in accordance with the changes in order to prevent the air discharged through the guide 36R and the air discharged through the guide 36L from coming into contact with each other.

The recording materials P are not cooled between the fixing unit 11 and the pair of ejection rollers 51 in the transport direction of the recording materials P but cooled after being ejected by the pair of ejection rollers 51, so that ultrafine particles that are generated from a toner wax in the image forming apparatus 100 can be kept in the image forming apparatus 100.

(Mechanism of Occurrence of UFPs)

The mechanism of the occurrence of ultrafine particles (hereinafter referred to as UFPs) from a toner wax will now be described. A wax in a toner is liquefied by applying heat and pressure to a toner image when the toner image passes through the press-contact nip portion N, and the wax exudes from the toner. In this case, a portion of the wax is vaporized and released into the air. In addition, a small portion of the wax remains on the film 22 even after the toner image has passed through the press-contact nip portion N and is vaporized as a result of being kept heated by the film 22. The vaporized wax becomes fine particles in the liquid or solid phase as a result of the ambient temperature. The UFPs, which have been generated, are caused to move in a direction toward the sheet-ejection opening 13 by an upward air flow due to air heated by the fixing unit 11 and by the flow (Couette flow) of air having a certain viscosity around the UFPs, the air flow being generated along with the movement of one of the recording materials P, and a portion of the UFPs may sometimes be discharged to outside of the image forming apparatus 100.

The longer UFPs, which are in a floating state, remain in the floating state, the more likely the UFPs are to be coagulated and attracted by the peripheral members. In addition, coagulation of the UFPs is more likely to occur as the concentration of the floating UFPs is higher. Thus, in order to promote the coagulation and to reduce the number concentration of the UFPs, it is necessary to increase the residence time of the UFPs in the image forming apparatus 100 by reducing the flow velocity of the air that transports the UFPs while maintaining a high concentration of the UFPs in a path from a source of the UFPs to the ejection opening 13.

(Comparison Between First Embodiment and Comparative Example 1)

Figure 8:
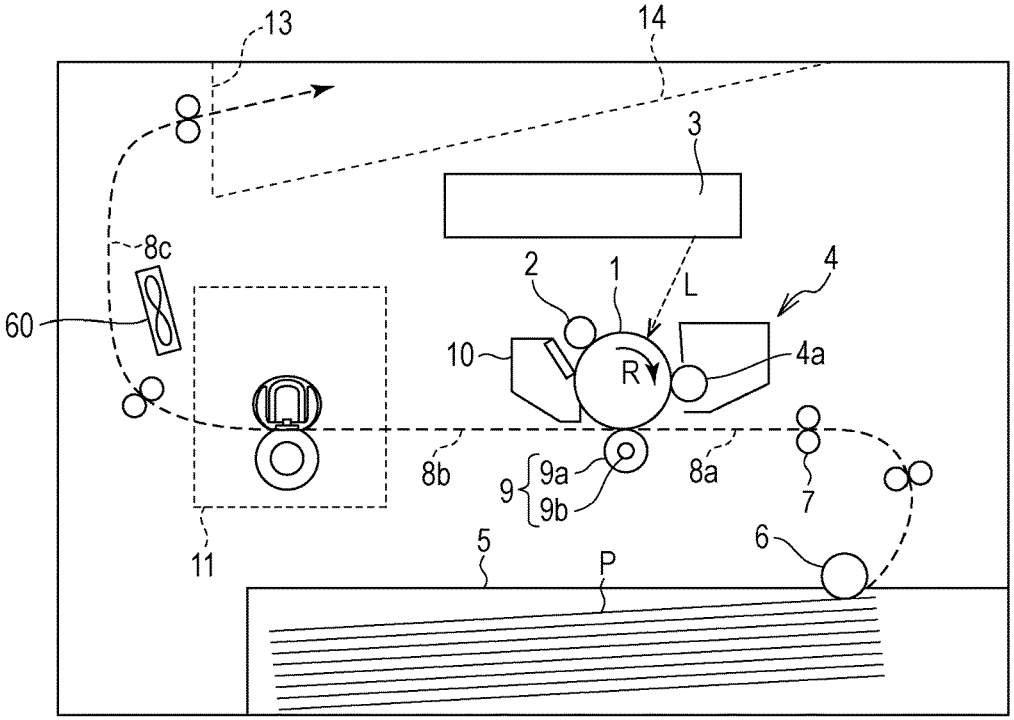
FIG. 8 is a schematic diagram illustrating an image forming apparatus according to Comparative Example 1.

The configuration of a cooling unit according to Comparative Example 1 will now be described for the sake of description of the advantageous effect of the first embodiment. FIG. 8 is a schematic diagram illustrating an image forming apparatus of Comparative Example 1. The image forming apparatus illustrated in FIG. 8 has a configuration in which a cooling fan 60, which serves as a cooling unit, is provided in a path from a fixing unit 11 to an ejection opening 13 and a pair of transport rollers 51, and in which no cooling unit is disposed on the side on which a stacking tray 14 is disposed. More specifically, as illustrated in FIG. 8, an axial flow fan 60 with external dimensions of 60 mm square and a thickness of 25 mm is disposed downstream from the nip portion N and is configured to cool one of the recording materials P, the recording material P having been ejected, by causing cooling air to be blown perpendicularly to a printing surface of the recording material P.

A comparative evaluation that is related to the number concentration of UFPs and the sticking of ejected recording materials to one another in the configuration of Comparative Example 1 and the configuration of the first embodiment was conducted. As a method for evaluating the UFPs, an image forming apparatus was disposed in a chamber of 3 cubic meters that was hermetically sealed and filled with purified air, and the concentration of the UFPs in the chamber immediately after printing an image having an image coverage rate of 5% for 5 minutes in a continuous manner was measured. A nanoparticle size distribution measuring apparatus FMPS3091 (manufactured by TSI Inc.) was used for the measurement. Regarding the sticking of the recording materials to one another, degrees of sticking were scored by sensory evaluation. No sticking is scored as an A, light sticking is scored as a B, and considerable sticking is scored as a C. Note that a laser beam printer (LBP) whose process speed is about 150 mm/sec and 27 ppm was used as the image forming apparatus.

Table 1 shows the results of a comparison that is related to the number concentration of UFPs and the sticking of recording materials to one another in the first embodiment and Comparative Example 1. Here, the unit of UFP number concentration is a percentage (%) value relative to the number concentration of 100% in Comparative Example 1.

TABLE 1

| | UFP number concentration (%) | Score for Sticking of Ejected and Cooled Recording Materials |
|---|---|---|
| First Embodiment | 60% | A |
| Comparative Example 1 | 100% | A |

As shown in Table 1, in the configuration of the first embodiment, the UFP number concentration can be reduced while the degree of sticking is kept low.

The reason why this can be achieved will now be described. UFPs are nanoscale particles grown by nucleation, which occurs as a result of a wax component of a toner deposited on the fixing film 22 or deposited on the pressure roller 24 volatilizing due to being heated to a high temperature and as a result of air becoming oversaturated with diffused high-boiling substances. In the first embodiment, the recording materials P that have been ejected are cooled at a position downstream from the ejection opening 13, and thus, the air flow through which substances derived from the UFPs are discharged to outside of the image forming apparatus 100 is not directly disturbed. In addition, since the cooling air that is used for cooling one of the recording materials P at a position outside of the sheet-ejection opening 13 flows along the surface of the recording material P, there is nothing that disturbs the air flow for the UFPs that have been discharged to outside of the image forming apparatus 100 through the ejection opening 13.

Figure 9A:
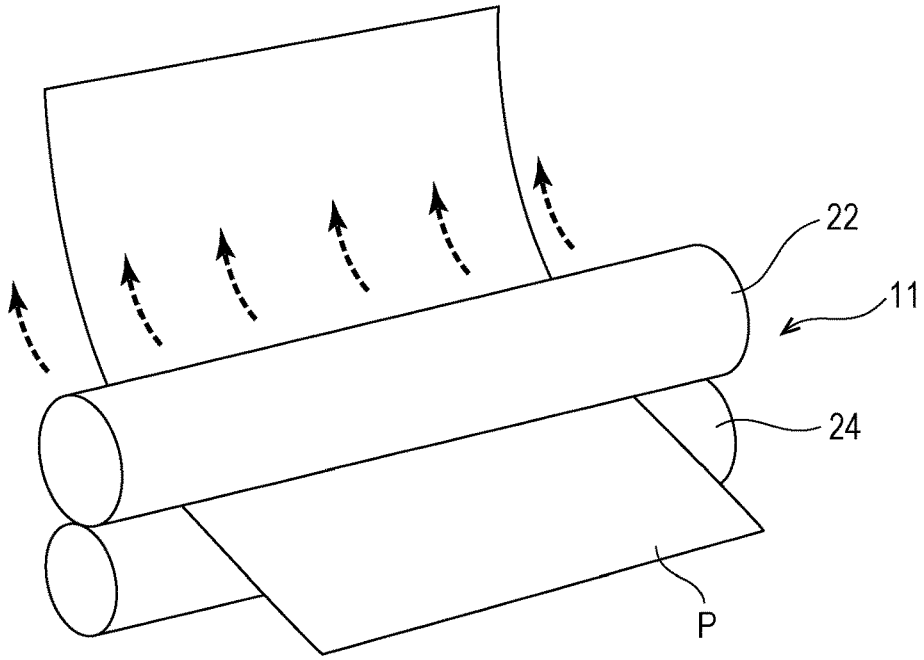
FIG. 9A is a diagram illustrating a configuration in which an axial flow fan is not disposed at a position downstream from a fixing unit.
Figure 9B:
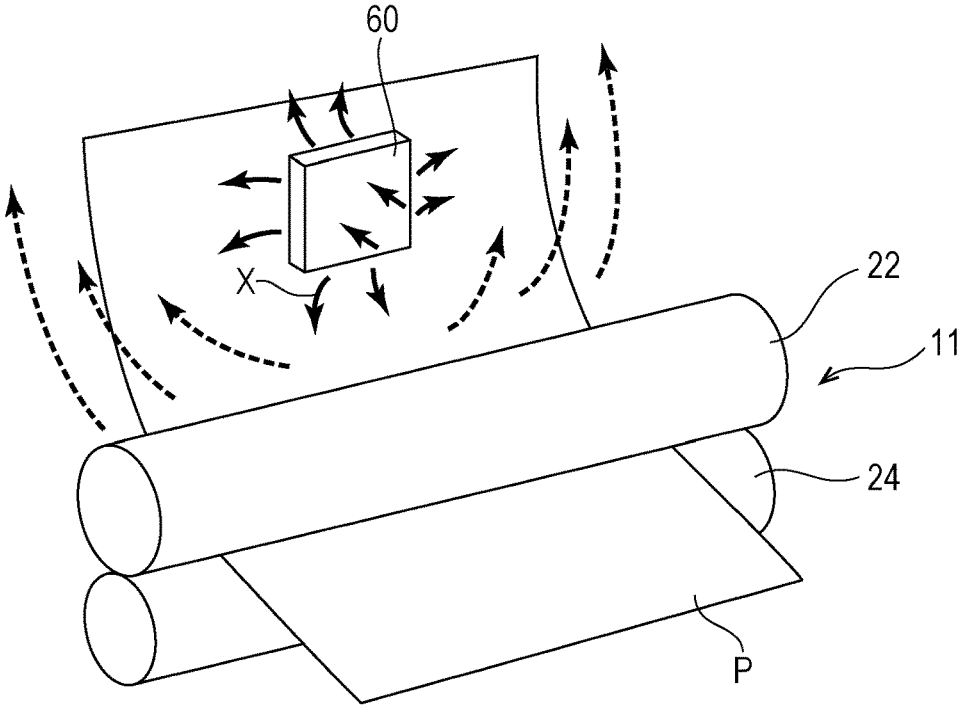
FIG. 9B is a diagram illustrating a configuration in which an axial flow fan is disposed at a position downstream from the fixing unit.

Here, the flows of the UFPs and the UFP-derived substances discharged from the fixing unit 11 (fixing film 22 and pressure roller 24) are schematically indicated by a velocity vector (dashed arrows) in FIG. 9A and FIG. 9B. FIG. 9A is a diagram illustrating a configuration in which an axial flow fan is not disposed at a position downstream from the fixing unit 11, and FIG. 9B is a diagram illustrating a configuration (Comparative Example 1) in which an axial flow fan is disposed at a position downstream from the fixing unit 11. As illustrated in FIG. 9A, it is assumed that the UFP-derived substances are caused to move slowly toward the sheet-ejection opening 13 by natural convection while maintaining a high concentration of the UFP-derived substances. Thus, the UFP-derived substances become particles as a result of being supersaturated through this moving process, and it is assumed that there is an increase in the probability of coagulation of the UFP-derived substances due to the particles coming into contact with one another and an increase in the probability that the particles will be attracted in the image forming apparatus 100 increase, so that the number concentration of the UFPs discharged outside of the image forming apparatus 100 is reduced.

On the other hand, in the configuration of Comparative Example 1, cooling air (solid arrows in FIG. 9B) that has been taken in from outside of the image forming apparatus is blown onto a recording material in the vicinity of the fixing unit 11. Thus, as indicated by the dashed arrows in FIG. 9B, the cooling air that comes into contact with and is reflected by the recording material becomes turbulent, and a portion of the cooling air forms an air flow X directed toward the fixing nip. The UFP-derived substances generated in the fixing unit 11 (fixing film 22 and pressure roller 24) are diffused by the air flow X, and the concentration of the UFP-derived substances in space is decreased.

Therefore, the coagulation of the particles is suppressed, and there is an increase in the probability of the UFPs being discharged to outside of the image forming apparatus 100 in a state where the number concentration is high. In addition, it is assumed that, as a result of an internal pressure of the image forming apparatus 100 becoming high due to the influence of the cooling air that has been taken in from outside of the image forming apparatus 100, the moving speed of the UFPs and the UFP-derived substances toward the sheet-ejection opening 13 is increased. As a result, the UFPs and the UFP-derived substances are discharged to outside of the image forming apparatus 100 for a short time, so that the coagulation of the UFPs is suppressed, and the probability of the UFPs being attracted by the peripheral members is reduced. Accordingly, the probability of the UFPs being discharged to outside of the image forming apparatus 100 increases.

Figure 10:
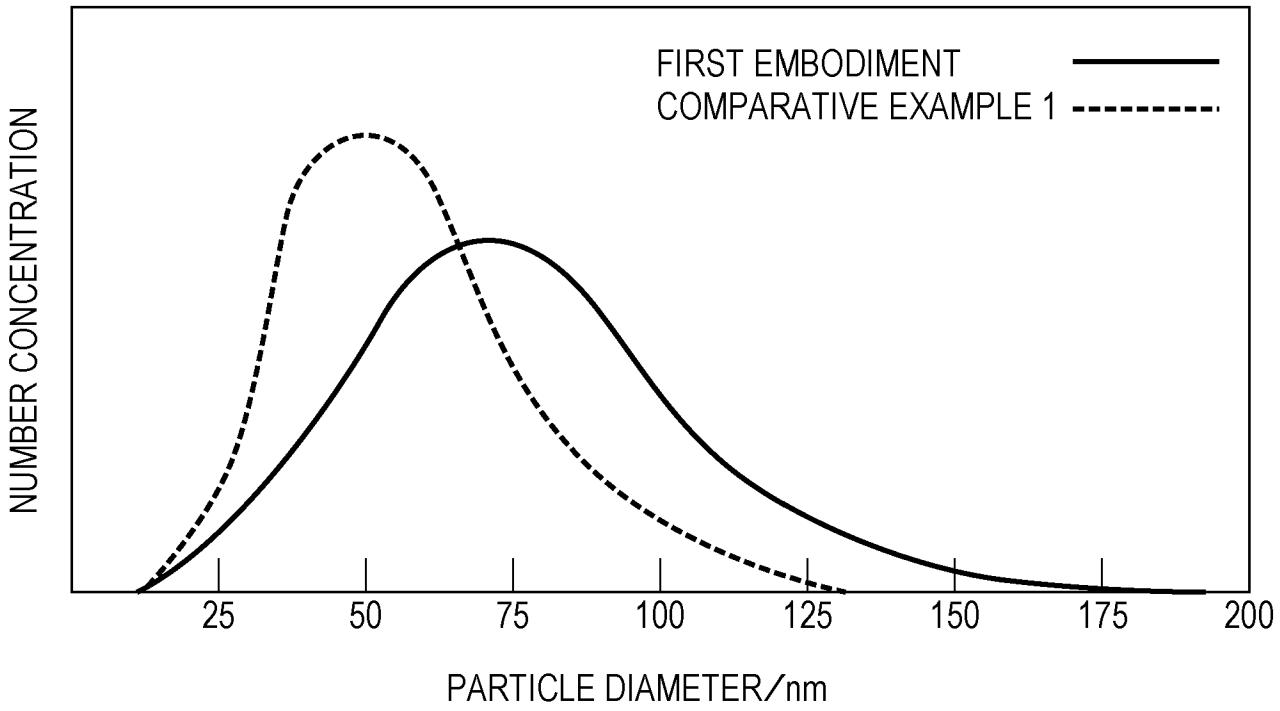
FIG. 10 is a graph comparing particle number concentration according to particle diameter in the first embodiment and Comparative Example 1.

FIG. 10 is a graph comparing particle number concentration according to particle diameter in the first embodiment and Comparative Example 1. A nanoparticle size distribution measuring apparatus FMPS3091 (manufactured by TSI Inc.) is used for the measurement. In FIG. 10, the horizontal axis represents the particle diameters (nm) of measured particles, and the vertical axis represents the particle number concentration according to the particle diameter. As shown in FIG. 10, in Comparative Example 1, the center of the distribution is 50 nm, which is a small particle diameter. On the other hand, in the first embodiment, the center of the distribution is shifted to a larger particle diameter, and the number concentration is decreased.

As described above, in the first embodiment, air is not blown in order to cool one of the recording materials P that is transported from the fixing unit 11 to the pair of ejection rollers 51, and the recording material is cooled at a position outside the ejection opening 13. Thus, the air flow through which the UFP-derived substances are discharged to outside of the image forming apparatus 100 is not directly disturbed. In addition, since the cooling air used for cooling the recording material at a position outside the sheet-ejection opening 13 is caused to flow along the surface of the recording material, there is nothing that disturbs the air flow for the UFPs and the UFP-derived substances. Therefore, in the first embodiment, the number concentration of the UFPs discharged to outside of the image forming apparatus 100 can be reduced while performing a necessary operation of cooling the recording materials P that have been ejected and suppressing the recording materials P from sticking to one another.

Second Embodiment

In the first embodiment, the configuration in which the air discharged through the exhaust ports 37R and 37L is blown in a direction perpendicular to the cut surface of one of the recording materials P has been described. In a second embodiment, a configuration in which the air discharged through the exhaust ports 37R and 37L is blown in a direction crossing the cut surface of one of the recording materials P will be described. More specifically, the configuration of each of the guides is changed. Note that the rest of the configuration of an image forming apparatus according to the second embodiment is the same as that of the image forming apparatus according to the first embodiment, and thus, similar reference numerals will be used in the following description.

Figure 7:
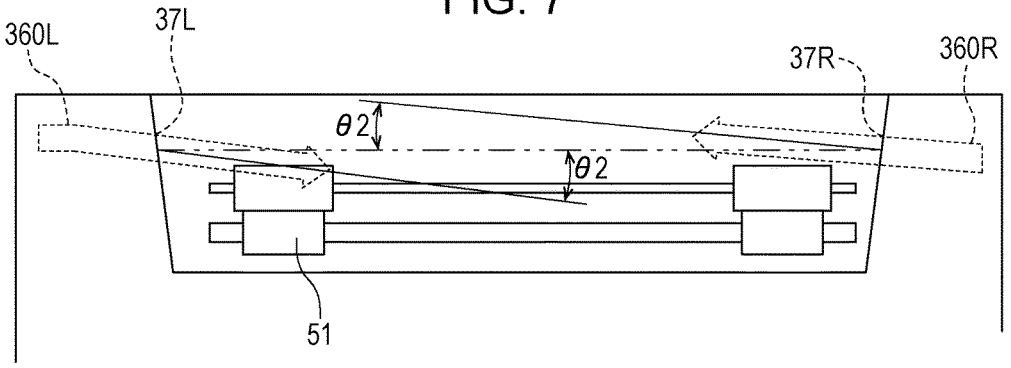
FIG. 7 is a schematic diagram illustrating guides according to a second embodiment.

FIG. 7 is a schematic diagram illustrating guides 360L and 360R according to the second embodiment and is a view when the sheet-ejection tray 14 is viewed from the transport direction of the recording materials P. As illustrated in FIG. 7, the guides 360R and 360L are arranged at a predetermined angle θ2 with respect to a line (two-dot chain line in FIG. 7) extending in a direction perpendicular to a height direction of the guides 360R and 360L in order to cause cooling air to be discharged at a desired angle. The predetermined angle θ2 of each of the guides 360R and 360L is set to 5 degrees, and since a longitudinal width (L5) of each of the guides 360R and 360L is 230 mm, as a result of the air being guided at 5 degrees, the air flow discharged through the guide 360R and the air flow discharged through the guide 360L are displaced from each other by about 20 mm at the exhaust ports 37R and 37L.

In addition, the guide 360L faces downward, and the guide 360R face upward with respect to a line tangent to the nip portion of the pair of ejection rollers 51. As a result, a top surface of one of the recording materials P can be cooled by the cooling air discharged through the exhaust port 37R by passing through the guide 360R, and a bottom surface of the recording material P can be cooled by the cooling air discharged through the exhaust port 37L by passing through the guide 360L. With this configuration, the recording material P can be effectively cooled, and the probability of the recording materials P on the sheet-ejection tray 14 sticking to one another can be reduced.

Other Embodiments

Although the shape of each of the exhaust ports 37R and 37L is a rectangular shape in the above embodiments, the opening shape may be a square shape, a round shape, a triangular shape, or the like as long as the air from the left exhaust port and the air from the right exhaust port do not come into contact with each other. In addition, although the configuration in which a single fan is used for sending cooling air to the exhaust ports 37R and 37L, and in which the air duct is separated into two duct paths so as to send air to each of the exhaust ports 37R and 37L has been presented, the present invention is not limited to this configuration. Two or more fans may be used for sending the cooling air to the exhaust ports 37R and 37L. In addition, a centrifugal fan may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-116138, filed Jun. 8, 2015, and 2015-117601, filed Jun. 10, 2015, which are hereby incorporated by reference herein in their entirety.

What is claimed is:

1. An image forming apparatus in which heat and pressure is applied to a toner image on a recording material by a fixing unit and in which the recording material to which the toner image has been fixed is ejected to a stacking unit, the image forming apparatus comprising:

a pair of ejection rollers that are used for ejecting the recording material to the stacking unit from a main body of the image forming apparatus; and a cooling unit that cools the recording material ejected to the stacking unit by the pair of ejection rollers by blowing air onto the recording material, wherein the cooling unit includes an air-blowing port that is used to blow air onto the recording material in a direction crossing a transport direction of the recording material, the air blowing port being located completely within a first region that is located above a first line extending horizontally from a nip portion of the pair of ejection rollers and below a second line extending upwards from the nip portion of the pair of ejection rollers at an acute angle to the first line, and the air blowing port being not located within a second region that is located above the first line and deviates from the first region.

2. The image forming apparatus according to claim 1, wherein a direction in which the recording material is ejected by the pair of ejection rollers is an upward direction with respect to a horizontal direction.

3. The image forming apparatus according to claim 2, wherein the cooling unit cools the recording material by causing the air to flow along a surface of the recording material.

4. The image forming apparatus according to claim 1, wherein the at least one air-blowing port is located at a position, in the direction in which the recording material is ejected, downstream from the pair of ejection rollers and upstream from a leading edge of the recording material stacked in the stacking unit.

5. The image forming apparatus according to claim 1, wherein the at least one air-blowing port includes a first air-blowing unit and a second air-blowing unit, the first air-blowing unit and the second air-blowing unit respectively being located on a first side and a second side in a width direction being perpendicular to the direction in which the recording material is ejected.

6. The image forming apparatus according to claim 5, wherein the first air-blowing unit and the second air-blowing unit are located at different positions in the direction in which the recording material is ejected.

7. The image forming apparatus according to claim 6, wherein a center line of the first air-blowing unit in an air blowing direction and a center line of the second air-blowing unit in the air blowing direction do not cross each other.

8. The image forming apparatus according to claim 5, wherein a direction in which the air is blown through the first air-blowing unit is an upward direction with respect to the extension line, and a direction in which the air is blown through the second air-blowing unit is a downward direction with respect to the extension line.

9. The image forming apparatus according to claim 5, wherein the cooling unit includes a common cooling fan that supplies cooling air to the first air-blowing unit and the second air-blowing unit.

10. The image forming apparatus according to claim 5, wherein the cooling unit includes a first guiding member that is used for guiding the air to the first air-blowing unit and a second guiding member that is used for guiding the air to the second air-blowing unit.

11. The image forming apparatus according to claim 1, wherein a direction in which the air is blown through the at least one air-blowing port is not oriented toward the pair of ejection rollers.

12. The image forming apparatus according to claim 1, wherein the cooling unit cools the recording material that has been ejected by the pair of ejection rollers instead of cooling the recording material at a position between the fixing unit and the pair of ejection rollers in the transport direction of the recording material.

13. An image forming apparatus comprising:

a fixing device that heats and pressurizes a toner image on a recording material;

a stacking unit which is located downstream of the fixing device and in which the recording material with toner image fixed thereon by the fixing device is stacked;

a pair of ejection rollers that are used for ejecting the recording material to the stacking unit from a main body of the image forming apparatus; and a cooling unit that cools the recording material ejected to the stacking unit by the pair of ejection rollers by blowing air onto the recording material, wherein the cooling unit includes an air-blowing port that is used to blow air onto the recording material in a direction crossing a transport direction of the recording material, and wherein the air-blowing port is located at a position above the stacking unit and completely within a first region formed by a first line extending horizontally from a nip portion of the pair of ejection rollers and a second line extending upwards from the nip portion of the pair of ejection rollers at an acute angle to the first line, and the air blowing port being not located within a second region that is located above the first line and deviates from the first region.

* * * * *